US012416211B1

(12) United States Patent
Zhan et al.

(10) Patent No.: US 12,416,211 B1
(45) Date of Patent: Sep. 16, 2025

(54) CUTTINGS TRAP FOR "AT BIT" MEASUREMENT OF DRILLED CUTTINGS

(71) Applicant: SAUDI ARABIAN OIL COMPANY, Dhahran (SA)

(72) Inventors: Guodong Zhan, Dhahran (SA); Bodong Li, Dhahran (SA); Fawaz M. Albahesh, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/605,117

(22) Filed: Mar. 14, 2024

(51) Int. Cl.
*E21B 27/00* (2006.01)
*E21B 17/10* (2006.01)
(Continued)

(52) U.S. Cl.
CPC ..... *E21B 27/005* (2013.01); *E21B 43/084* (2013.01); *E21B 49/005* (2013.01); *E21B 17/1078* (2013.01); *E21B 47/005* (2020.05)

(58) Field of Classification Search
CPC .. E21B 17/1078; E21B 17/1092; E21B 27/00; E21B 27/005; E21B 43/084; E21B 12/00; E21B 49/005; E21B 49/10
See application file for complete search history.

(56) References Cited

U.S. PATENT DOCUMENTS 2,819,038 A * 1/1958 Eckel ..... E21B 49/02 175/308
4,111,262 A * 9/1978 Duncan ..... E21B 31/08 166/99
(Continued)

FOREIGN PATENT DOCUMENTS

CN 107789885 A * 3/2018 ..... B01D 29/03
CN 108035682 A 5/2018
(Continued)

OTHER PUBLICATIONS

Liu et al., "Real-Time Bit Wear Monitoring and Prediction Using Surface Mechanics Data Analytics: A Step Toward Digitization Through Agile Development," Society of Petroleum Engineers and IADC, IADC/SPE-189602-MS, Mar. 6, 2018, 9 pages.
(Continued)

*Primary Examiner* — Jennifer H Gay
(74) *Attorney, Agent, or Firm* — Osha Bergman Watanabe & Burton LLP

(57) ABSTRACT

A cuttings collection system includes a drill bit at the end of a toolstring, a stabilizer connected to the drill bit, a cuttings catcher arranged around the stabilizer with apertures having a size less than an average size of cuttings generated by the drill bit and retractability, and sensors installed in a body of the stabilizer. A cuttings catcher includes a housing with recesses and a retractable mesh installed in each of the recesses. A method of operating an at-bit cuttings catcher system includes providing a toolstring with a drill bit, a stabilizer, a cuttings catcher, and a measurement-while-drilling tool, where the cuttings catcher includes a housing with recesses and a mesh installed in the recesses, drilling a formation using the drill bit, producing cuttings of the formation, extending the mesh from the housing of the cuttings catcher, catching cuttings in the cuttings catcher, and analyzing the cuttings using sensors.

18 Claims, 5 Drawing Sheets

(51) Int. Cl.
*E21B 43/08* (2006.01)
*E21B 47/005* (2012.01)
*E21B 49/00* (2006.01)

(56) References Cited

U.S. PATENT DOCUMENTS 8,474,522 B2 * 7/2013 Lynde ..... E21B 27/005 166/99
9,719,304 B2 8/2017 Radford et al.
9,850,728 B2 12/2017 Wessel
9,879,493 B2 1/2018 Berger
10,584,534 B2 3/2020 Hagar et al.
11,371,332 B2 * 6/2022 Xiao ..... E21B 43/088
12,258,852 B1 * 3/2025 Aljeaban ..... E21B 37/02
2007/0272404 A1 * 11/2007 Lynde ..... E21B 47/18 166/99
2009/0173541 A1 * 7/2009 Tulloch ..... E21B 7/062 175/45
2010/0186951 A1 * 7/2010 Church ..... E21B 49/10 166/264
2010/0276197 A1 11/2010 Mathieu
2012/0160514 A1 * 6/2012 Evans, II ..... E21B 49/10 166/325
2013/0105222 A1 * 5/2013 Pate ..... E21B 17/1014 175/40
2014/0131031 A1 * 5/2014 Tingat Cody ..... E21B 43/086 166/179
2015/0218940 A1 * 8/2015 Pelletier ..... E21B 49/005 175/41
2017/0114596 A1 * 4/2017 Krid ..... E21B 17/1078
2018/0171772 A1 6/2018 Rodney
2018/0216458 A1 * 8/2018 Garcia ..... E21B 49/10
2020/0332652 A1 10/2020 Sehsah et al.
2021/0324702 A1 * 10/2021 Li ..... E21B 43/10
2021/0324722 A1 * 10/2021 Xiao ..... E21B 43/38
2022/0268103 A1 8/2022 Stenberg et al.
2024/0344455 A1 * 10/2024 Patwa ..... E21B 49/082
2025/0101855 A1 * 3/2025 Aljeaban ..... E21B 47/0025

FOREIGN PATENT DOCUMENTS

CN 210530768 U 5/2020
GB 2398308 A 8/2004
NO 146294 B * 5/1982 ..... E21B 49/10

OTHER PUBLICATIONS

International Search Report and Written Opinion issued in Application No. PCT/US2025/019469, mailed on Jul. 14, 2025 (18 pages).

* cited by examiner

CUTTINGS TRAP FOR "AT BIT" MEASUREMENT OF DRILLED CUTTINGS

BACKGROUND

In drilling operations, harsh drilling conditions, such as low rate of penetration (ROP), vibrations, high pressures and high temperatures, are often present, all of which place increased stress on drill bits. In conventional drilling operations, real-time drill bit information or data is not available. Drilling advisors are required to consider drill bit condition when making decisions to optimize drilling parameters. Further, drill bit condition affects both invisible lost time (ILT) and non-productive time (NPT), which contribute to overall drilling costs. For example, ROP drops as wear progresses (contributing to ILT) and significant wear requires a bit replacement operation (contributing to NPT). Understanding bit conditions in real-time can extend bit life, reducing ILT and NPT.

Cuttings generated during drilling operations provide real-time characteristics of the drilled formation. For example, real-time elemental analysis from x-ray fluorescence (XRF) on drilling cuttings can assist in identifying rock which may cause drill bit metamorphism. The data collected from XRF may be directed to geo-steering users to identify lithological heterogeneity. Further, real-time application of alkene detection for identifying drill bit metamorphism combined with XRF elemental analysis to identify an abrasive silica rich layer can be utilized to aid geo-steering and to provide early alerts to prevent excessive drill bit wear. If necessary, the BHA may be withdrawn from the wellbore to prevent severe damage to the bit, which may assist in avoiding junk in the wellbore.

Currently, manual collection and identification of cuttings is a tedious and unfeasible task for real-time applications. Further, current processes for identification of sub-optimal equipment performance are often unreliable and inconsistent due to unexpected or unplanned solids in rig processing or solid control systems.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cuttings collection system. The cuttings collection system may include a drill bit provided at an end of a toolstring, a stabilizer connected to the drill bit, a cuttings catcher arranged around the stabilizer, and one or more sensors installed in a body of the stabilizer. The cuttings catcher may include apertures having a size less than an average size of cuttings generated by the drill bit and may be retractable.

In other aspects, embodiments disclosed herein relate to a cuttings catcher including a housing with one or more recesses and a retractable mesh installed in each of the one or more recesses.

In other aspects, embodiments disclosed herein relate to a method of operating an at-bit cuttings catcher system. The method may include providing a toolstring where the toolstring includes a drill bit, a stabilizer, a cuttings catcher, and a measurement-while-drilling tool, where the cuttings catcher includes a housing with one or more recesses and a mesh installed in one or more recesses. The method may include drilling a formation using the drill bit, producing a plurality of cuttings of the formation, extending the mesh from the housing of the cuttings catcher, catching a plurality of cuttings in the cuttings catcher, and analyzing the plurality of cuttings using one or more sensors.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

In the following description of FIGS. 1-5, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a seismic data set" includes reference to one or more of such seismic data set.

Terms such as "approximately," "substantially," "about," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

In one aspect, embodiments disclosed herein relate to an at-bit cuttings collection system secured to a toolstring, where the system includes a cuttings catcher configured to collect cuttings for real-time analysis.

Figure 1:
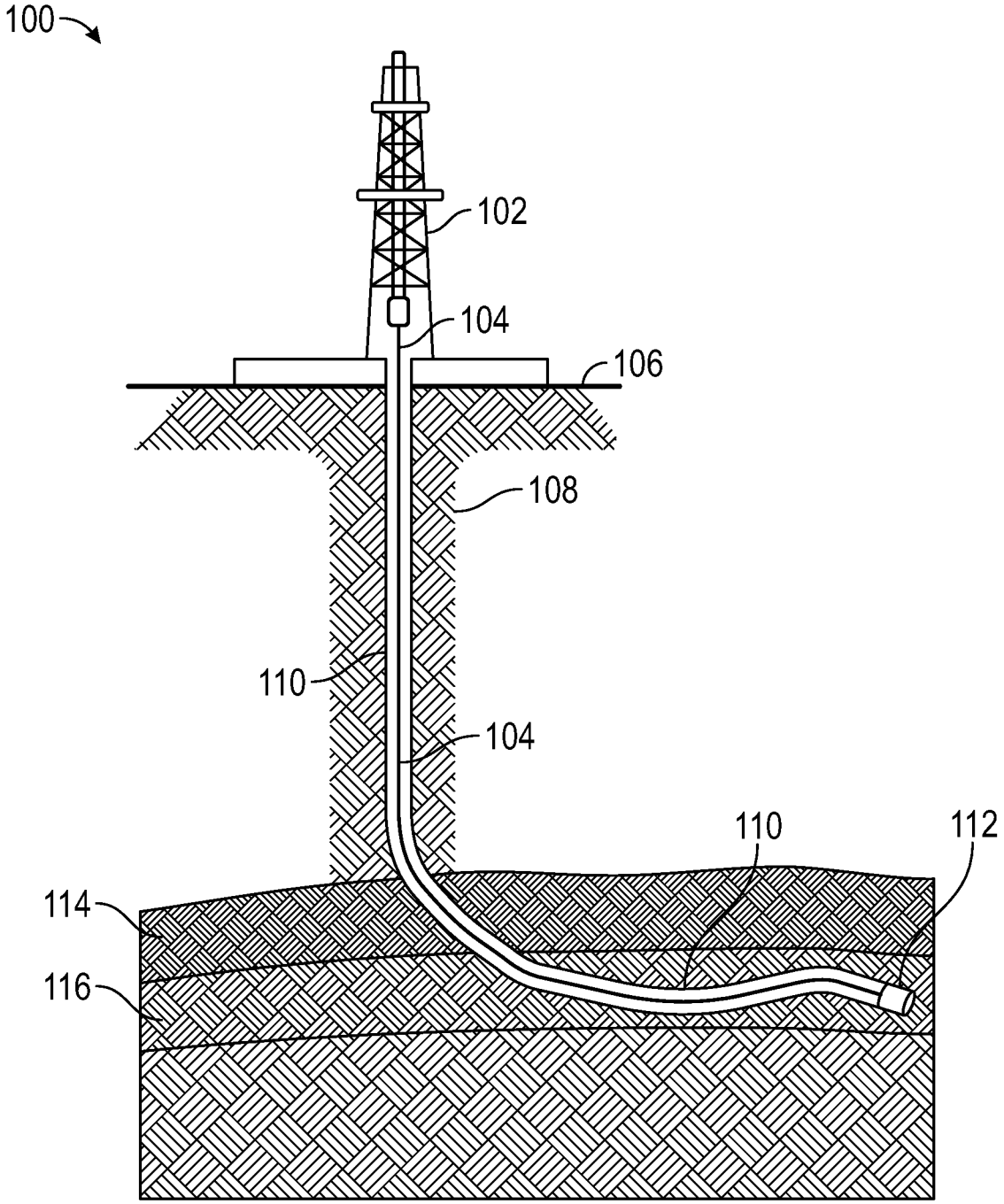
FIG. 1 shows an exemplary well system.

FIG. 1 illustrates an exemplary well system 100 in accordance with one or more embodiments. As shown in FIG. 1, a well path 110 may be drilled by a drill bit 112 attached by a toolstring 104 to a drill rig 102 located on the surface of the earth 106. The well may traverse a plurality of overburden layers 108 and one or more cap-rock layers 114 to a formation 116. The well path 110 may be a curved well path, or a straight well path. In one or more embodiments, the well path 110 may be described as vertical, deviated, horizontal, or extended reach drilling (ERD). One skilled in the art will be aware that deviated, horizontal, and ERD wells are considered to be complex.

Figure 2:
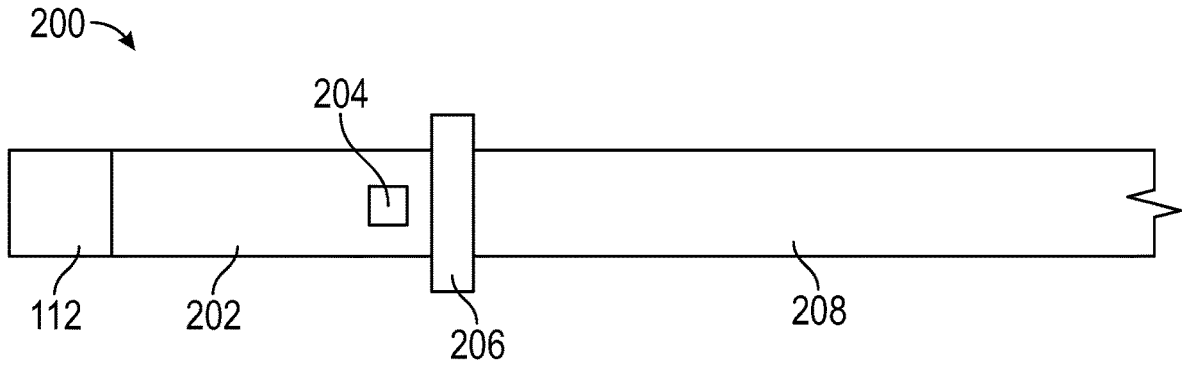
FIG. 2 shows an at-bit cuttings collection system in accordance with one or more embodiments.

FIG. 2 shows a cuttings collection system 200 in accordance with one or more embodiments. A near-bit stabilizer 202 may be secured directly uphole of the drill bit 112. The near-bit stabilizer 202 may be a sleeve-type stabilizer or an integral-type stabilizer. One or more sensors 204 may be secured to the near-bit stabilizer 202. A cuttings catcher 206 may be secured around the near-bit stabilizer 202. The cuttings catcher 206 may include mesh halves attached to a housing. A measurement-while-drilling (MWD) tool 208 may be secured to the toolstring uphole of the cuttings catcher 206.

Figure 3:
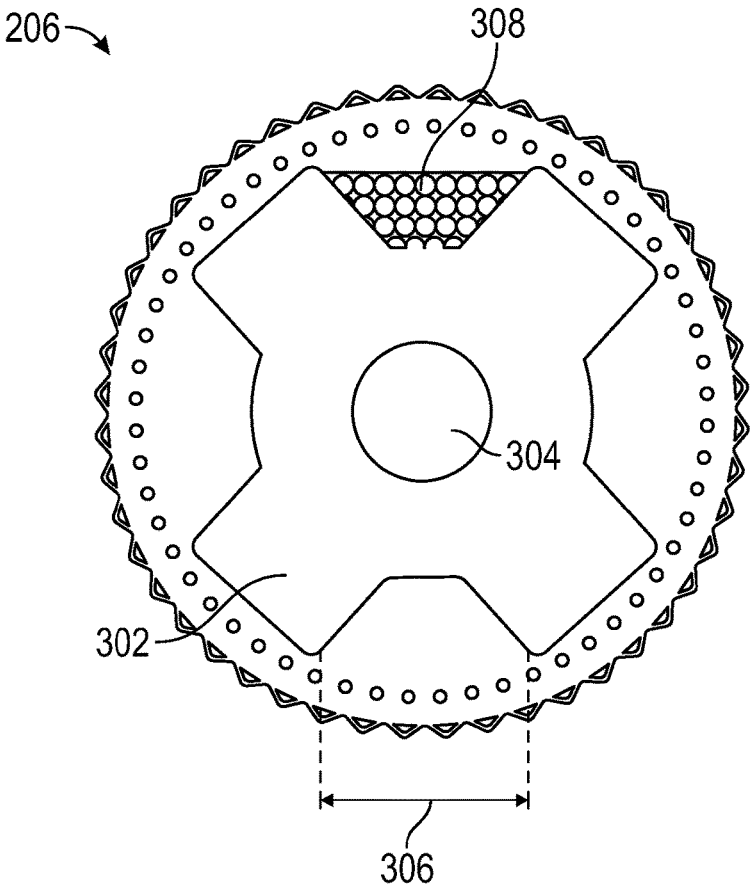
FIG. 3 shows a cuttings catcher in accordance with one or more embodiments.

FIG. 3 shows the cuttings catcher 206 in accordance with one or more embodiments. The cuttings catcher 206 may include a housing 302 which may include a central aperture 304 which may fit around the stabilizer 202. One or more recesses 306 may be integrally formed in the housing 302. In one or more embodiments, each of the one or more recesses 306 may have a U-shaped cross-sectional profile, with three straight sides. However, there may be other embodiments in which the one or more recesses 306 have a different shape without departing from the scope of this disclosure. A mesh 308 may be installed in at least one of the recesses 306. For example, in some embodiments, a mesh 308 may be installed in two of the recesses 306.

Figure 4B:
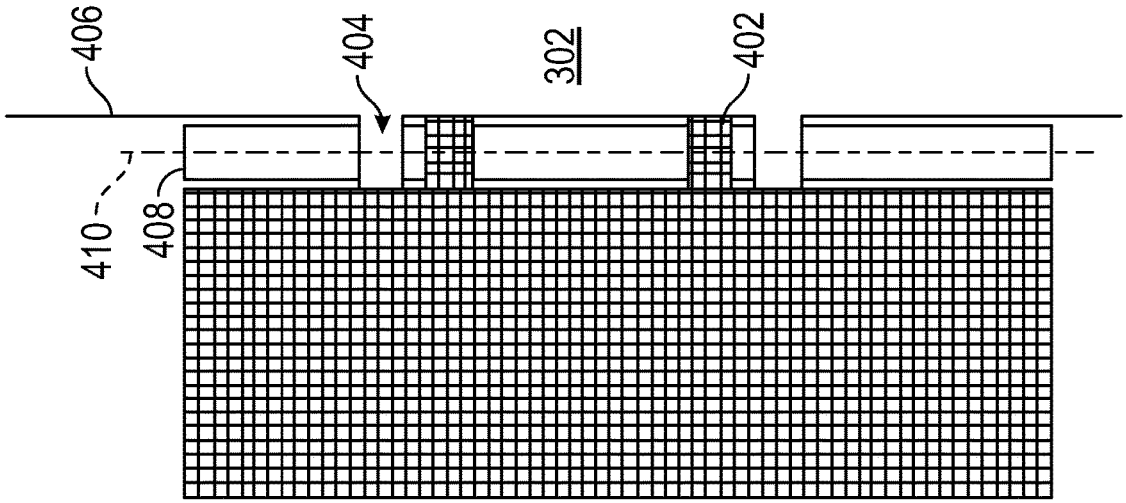
FIGS. 4A and 4B show a cuttings catcher in accordance with one or more embodiments.
Figure 4A:
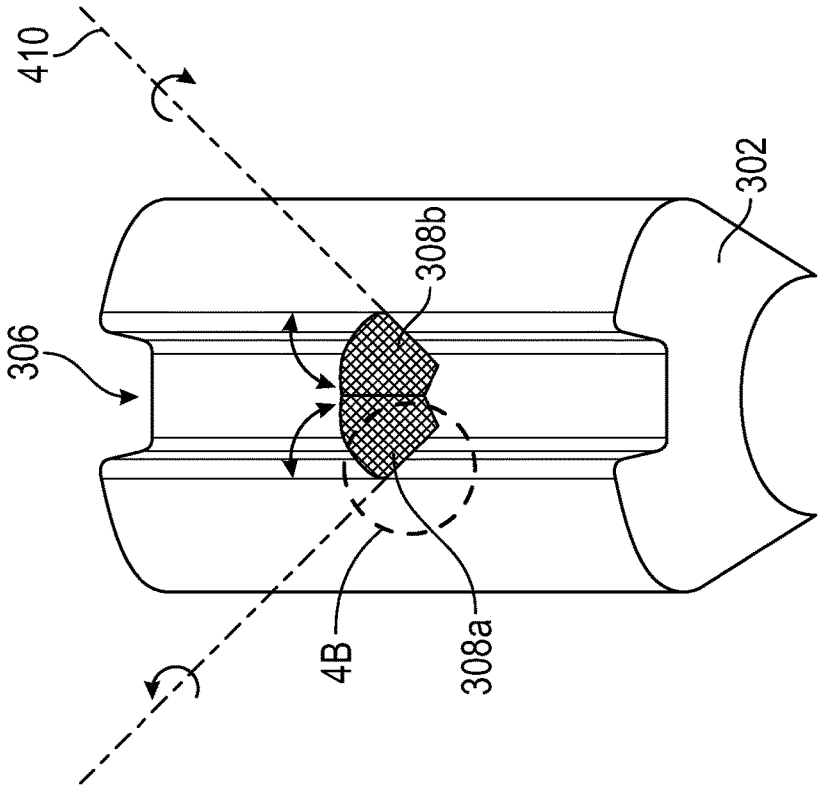
Figure 5A:
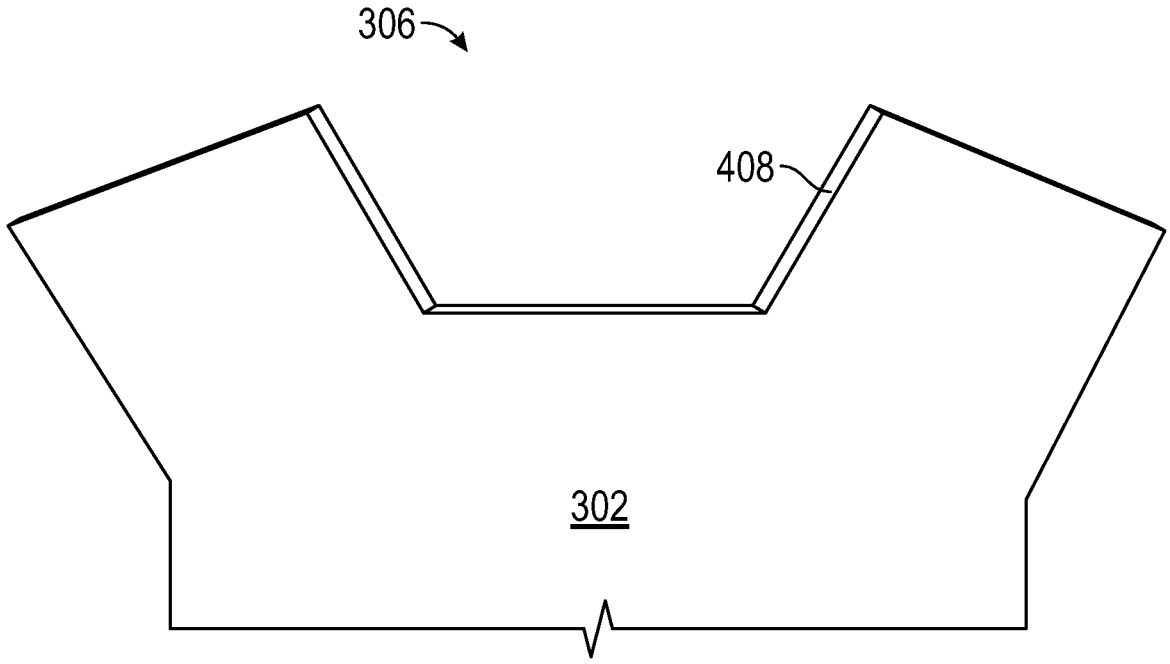
FIGS. 5A and 5B show a cuttings catcher in accordance with one or more embodiments.
Figure 5B:
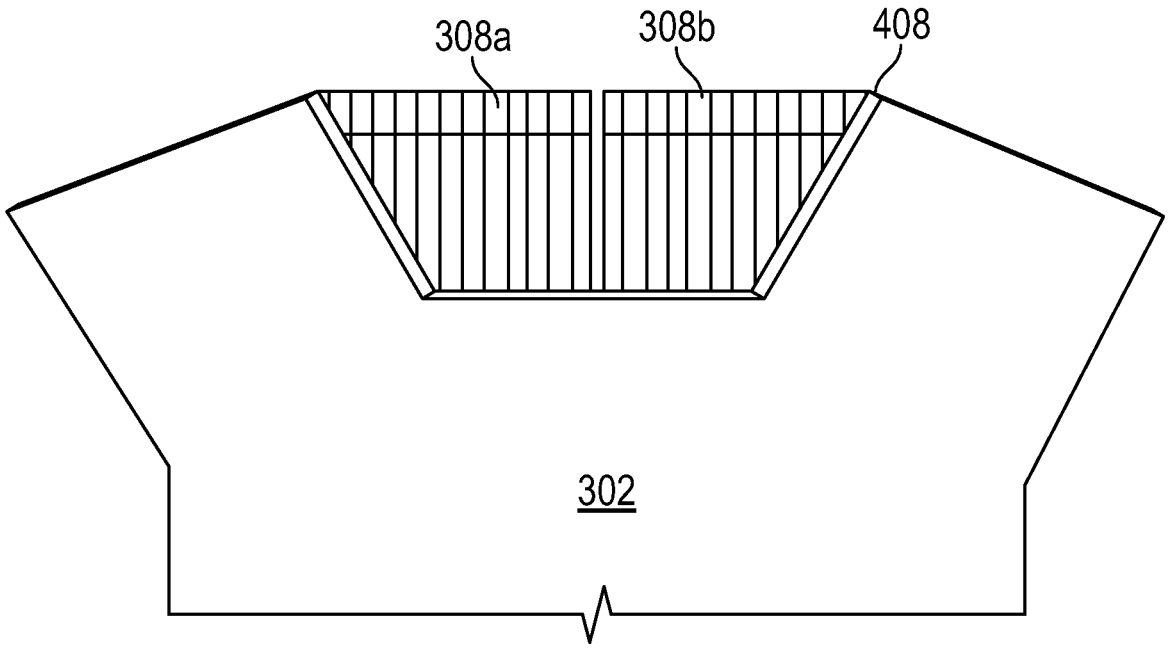

In one or more embodiments, as shown in FIGS. 4A-B, the mesh 308 may be composed of two halves, 308*a* and 308*b*. Each of the halves 308*a*, 308*b* may be secured to the housing 302 via one or more connection points 402 integrally formed in each half 308*a*, 308*b* and via one or more pivots 404 integrally formed in the recess wall 406 of the housing 302. Each of the connection point 402 and the pivot 404 may represent an extended member with a central aperture through which a shaft 408 may be fitted. The mesh halves 308*a*, 308*b* may therefore rotate about a central axis 410 of the shaft 408 between a retracted position and an extended position, which are illustrated in FIGS. 5A and 5B, respectively. In one or more embodiments, the mesh halves 308*a*, 308*b* may extend and retract independently of each other. Additionally, in one or more embodiments, other hinge-type connection configurations may be used to pivotably connect a mesh within a recess.

As shown in FIG. 5A, when the mesh halves 308*a*, 308*b* are in a retracted position, they may be flush with the recess wall 406. A retracted position, therefore, may refer to the position of the mesh halves 308*a*, 308*b* when they are at 0° rotation about the central axis 410 of the shaft 408. An extended position, shown in FIG. 5B, may refer to the position of the mesh halves 308*a*, 308*b* when they are at 90° rotation about the central axis 410 of the shaft 408. Accordingly, in an extended position, the mesh halves 308*a*, 308*b* may fill the recess 306, creating a barrier through which cuttings cannot pass. The size of the mesh 308 apertures may be selected by a user to accommodate the expected cuttings size. For example, the size of the mesh apertures may be selected to be less than an average size of cuttings from the connected drill bit 112. The average size of cuttings generated from a drill bit may be predicted (e.g., from previously collected data from drilling like-type formations) and/or determined from cuttings collection at the surface, for example.

The mesh halves 308*a*, 308*b* may be rotated from a 0° rotation to a 90° rotation. The rotation may be actuated by a hydraulic motor. The hydraulic motor may be any commercially available hydraulic motor suitable for use downhole.

When the mesh 308 is in an extended position, the mesh 308 may allow for the collection of cuttings. Once cuttings have been collected, the sensors 204, shown in FIG. 2, may be used to analyze the cuttings. For example, the sensors 204 may be configured to measure various formation characteristics, such as temperature, pressure, force, gamma-rays, and combinations thereof. Measurements taken by the sensors 204 may be sent (e.g., via wired connection) to an MWD tool 208 secured to the toolstring uphole of the cuttings catcher 206. In some embodiments, measurements taken by the sensors 204 may be sent through a wired connection to the surface of the well, for example, to a computer system located at the surface, for data collection and analysis. Once the desired measurements have been made, the mesh 308 may then be retracted, releasing the cuttings into the wellbore.

Figure 6:
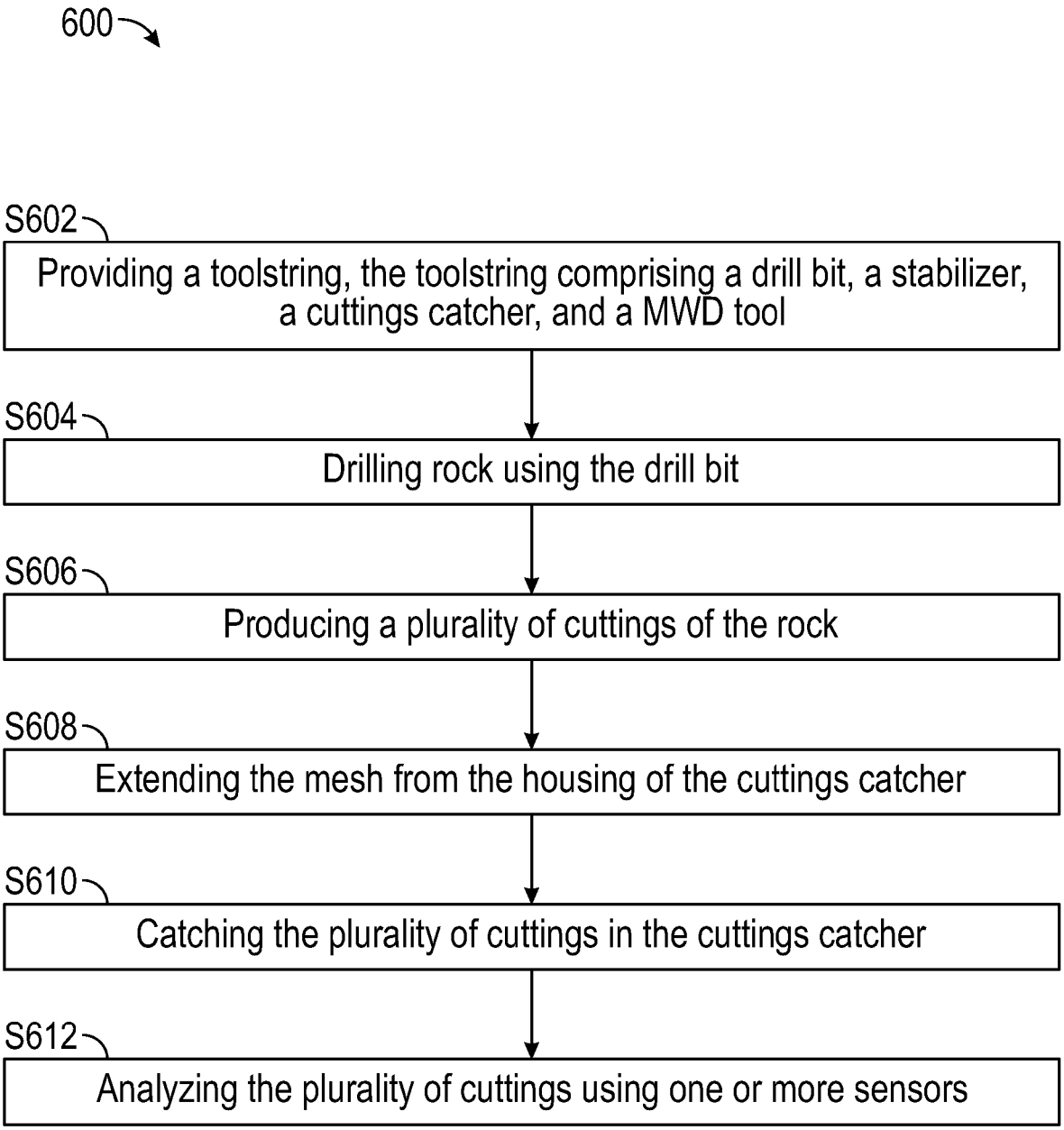
FIG. 6 shows a flowchart of a method in accordance with one or more embodiments.

FIG. 6 depicts a flowchart in accordance with one or more embodiments. More specifically, FIG. 6 depicts a flowchart 600 of a method of determining successful functionality of one or more inflow control devices according to embodiments of the present disclosure. Further, one or more blocks in FIG. 6 may be performed by one or more components as described in FIGS. 1-5B. While the various blocks in FIG. 6 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a toolstring 104 may be provided, S602. The toolstring 104 may include a drill bit 112, a stabilizer 202, a cuttings catcher 206 and a MWD tool 208. The cuttings catcher 206 may include a housing 302 with one or more recesses 306 and at least one mesh 308 installed in at least one of the recesses 306. The mesh 308 may be composed of two halves 308*a*, 308*b*, each of which may be configured to retract and extend as desired, either in unison or independently of one another.

The formation 116 may be drilled using the drill bit 112, S604. In the process of drilling, a plurality of cuttings of the formation 116 may be generated, S606. The size of the cuttings, in accordance with one or more embodiments, may be estimated, and the estimation may be used to select the size of the mesh 308 installed in the cuttings catcher 206 so that cuttings are not able to pass through apertures in the mesh 308.

The mesh 308 may extended from the housing 302 of the cuttings catcher 206, S608. More specifically, the mesh halves 308*a*, 308*b* may be rotated 90° from a retracted position to an extended position about the central axis 410 of the shaft 408. After extension of the mesh halves 308*a*, 308*b*, the plurality of cuttings may be caught in the cuttings catcher 206, S610. Once caught, the cuttings may be analyzed using sensors 204 installed on the stabilizer 202, S612.

In one or more embodiments, once the desired measurements and analysis of the cuttings has been completed, the mesh 308 may be retracted into the housing 302 of the cuttings catcher 206. Once the mesh 308 has been retracted, the plurality of cuttings may then be released into the wellbore.

In one or more embodiments, extension and retraction of the mesh 308 may be controlled by a user at a surface location, who may manually input a user command to retract or extend the mesh 308 via a wired connection through the MWD tool 208. In other embodiments, extension and retraction of the mesh 308 may be automatically controlled based on a predetermined timed schedule. More specifically, extension and retraction of the mesh 308 may occur in intervals after a desired period of time. For example, in one or more embodiments, the mesh 308 may be extended and remain extended for short period of time, such as one minute, before it may be retracted and remain retracted for a longer period of time, on the order of a few hours. This may be repeated throughout the drilling operation to acquire regular cuttings analysis.

Catching and analysis of formation 116 cuttings proximate the drill bit 112 allows for real-time determination of formation 116 characteristics, which has previously been unfeasible. Accordingly, drilling conditions, particularly those related to wear and condition of the drill bit 112, may be transmitted to users in real-time, so that decisions may be made in relation to preservation of drilling equipment. Further, predictions regarding the reservoir and its potential may also be made by users in real-time due to measurements taken by the sensors 204 installed proximate the cuttings catcher 206.

Embodiments of the present disclosure may provide at least one of the following advantages. Conventionally available drilling systems are not capable of providing real-time data regarding drill bit condition and formation characteristics. Rather, commercially available systems often require drill bit replacement due to bit damage, which results in costly time delays and reduction in drilling efficiency. Embodiments of the present disclosure allow for real-time, near-bit analysis of formation cuttings to the surface for the purpose of monitoring drill bit condition and formation characteristics. Such real-time data allows operators to make more informed decisions regarding drilling operations, particularly with respect to drill bit replacement. Real-time data allows for a reduction in non-production time and invisible lost time, since it allows users to determine when the condition of the drill bit has deteriorated to a level at which drilling efficiency is no longer above an acceptable threshold.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. Although multiple dependent claims are not introduced, it would be apparent to one of ordinary skill that the subject matter of the dependent claims of one or more embodiments may be combined with other dependent claims.

What is claimed:

1. A cuttings collection system, comprising:
a drill bit provided at an end of a toolstring;
a stabilizer connected to the drill bit;
a cuttings catcher secured to the stabilizer, the cuttings catcher comprising:
a housing having a recess; and
a mesh connected to the recess via a pivot connection, wherein the mesh comprises apertures having a size less than an average size of cuttings generated by the drill bit, and
wherein the mesh is retractable; and
one or more sensors installed in a body of the stabilizer.

2. The cuttings collection system of claim 1, wherein the one or more sensors are configured to analyze a plurality of cuttings.

3. The cuttings collection system of claim 1, wherein the housing comprises one or more additional recesses, and wherein an additional mesh is installed in each of the one or more additional recesses, wherein the apertures are formed through the additional mesh.

4. The cuttings collection system of claim 1, wherein the pivot connection comprises a pivot integrally formed in the recess of the housing, and a shaft extending through the pivot and a connection point on the mesh.

5. The cuttings collection system of claim 4, wherein the mesh is configured to rotate about the shaft between 0° and 90°, wherein 0° represents a retracted position and 90° represents an extended position.

6. The cuttings collection system of claim 1, wherein the recess has a U-shaped cross-sectional profile.

7. The cuttings collection system of claim 1, wherein the mesh comprises two halves, each half configured to independently retract.

8. The cuttings collection system of claim 1, further comprising a measurement-while-drilling (MWD) tool wired uphole of the stabilizer.

9. A cuttings catcher, comprising:
a housing comprising a recess;
a retractable mesh installed in the recess; and
a pivot integrally formed in the one or more recesses of the housing, and a shaft extending through the pivot and a connection point on the retractable mesh,
wherein, when the retractable mesh is in an extended position, the retractable mesh extends across the recess to fill the recess.

10. The cuttings catcher of claim 9, wherein the retractable mesh is configured to rotate about the shaft between 0° and 90°, wherein at 0°, the retractable mesh is in a retracted position, and at 90°, the retractable mesh is in the extended position.

11. The cuttings catcher of claim 9, wherein the recess has a U-shaped cross-sectional profile.

12. The cuttings catcher of claim 9, wherein the retractable mesh comprises two halves, each half configured to independently retract.

13. A method of operating an at-bit cuttings catcher system, comprising:

providing a toolstring, the toolstring comprising a drill bit, a stabilizer, a cuttings catcher, and a measurement-while-drilling (MWD) tool, wherein the cuttings catcher is secured to the stabilizer, and wherein the cuttings catcher comprises a housing with one or more recesses, and a mesh installed in the one or more recesses;

drilling a formation using the drill bit;

producing a plurality of cuttings of the formation;

extending the mesh from the housing of the cuttings catcher, wherein extending the mesh from the housing of the cuttings catcher comprises rotating the mesh about a shaft at a connection point from a retracted position to an extended position;

catching a plurality of cuttings in the cuttings catcher; and analyzing the plurality of cuttings using one or more sensors.

14. The method of claim 13, further comprising:

retracting the mesh into the housing of the cuttings catcher; and releasing the plurality of cuttings.

15. The method of claim 14, wherein retracting the mesh into the housing of the cuttings catcher comprises rotating the mesh about a shaft at a connection point from an extended position to a retracted position.

16. The method of claim 13, further comprising controlling an extension and a retraction of the mesh with a user command inputted at a surface location.

17. The method of claim 13, further comprising automatically controlling an extension and a retraction of the mesh on a timed schedule.

18. The method of claim 13, wherein analyzing the plurality of cuttings comprises collecting data from the one or more sensors using the measurement-while-drilling (MWD) tool and transmitting the data via a wired connection to a user at a surface location.

* * * * *